US007057524B2

(12) United States Patent
Innes

(10) Patent No.: US 7,057,524 B2
(45) Date of Patent: Jun. 6, 2006

(54) PRESSURE PULSE GENERATOR FOR MWD

(75) Inventor: Frank Innes, Dyce (GB)

(73) Assignee: Geolink (UK) Ltd., Aberdeen (GB)

( * ) Notice: Subject to any disclaimer, the term of this patent is extended or adjusted under 35 U.S.C. 154(b) by 445 days.

(21) Appl. No.: 10/466,986

(22) PCT Filed: Jan. 22, 2002

(86) PCT No.: PCT/GB02/00289

§ 371 (c)(1),
(2), (4) Date: Jul. 23, 2003

(87) PCT Pub. No.: WO02/059460

PCT Pub. Date: Aug. 1, 2002

(65) Prior Publication Data

US 2004/0081019 A1 Apr. 29, 2004

(30) Foreign Application Priority Data

Jan. 24, 2001 (GB) ..... 0101802.7
Mar. 5, 2001 (GB) ..... 0105312.3

(51) Int. Cl.
*G01V 1/02* (2006.01)

(52) U.S. Cl. ..... 340/855.4; 367/83; 367/85

(58) Field of Classification Search ..... 340/854.3; 175/45, 48; 367/85, 83, 84
See application file for complete search history.

(56) References Cited

U.S. PATENT DOCUMENTS

| | | | |
|---|---|---|---|
| 4,550,392 | A | 10/1985 | Mumby |
| 4,742,498 | A | 5/1988 | Barron |
| 5,802,011 | A | 9/1998 | Winters et al. |
| 6,016,288 | A | 1/2000 | Frith |
| 6,089,332 | A | 7/2000 | Barr et al. |

FOREIGN PATENT DOCUMENTS

| | | |
|---|---|---|
| GB | 2328459 | 2/1999 |
| GB | 2360800 | 10/2001 |

*Primary Examiner*—Michael Horabik
*Assistant Examiner*—Hung Q. Dang
(74) *Attorney, Agent, or Firm*—Madson & Austin

(57) ABSTRACT

A pressure pulse generator to generate pressure signals in drilling fluid for transmission to surface includes an outer housing having an inlet and an outlet for supply to the drilling assembly; a control element slidably mounted in the housing for opening and closing said inlet, the element being operative to generate a pressure pulses when it closes; a control passage extending through the element and closable by a valve element arranged to be exposed to the pressure in the passage; and an actuator assembly connected to the control element. The control element moves upon activation relative to the inlet to generate a pulse. When deactivated, it blocks the flow through the passage so that all of the fluid bypasses via the inlet.

5 Claims, 4 Drawing Sheets

PRESSURE PULSE GENERATOR FOR MWD

This invention relates to a system of communication employed during the drilling of boreholes in the earth for purposes such as oil or gas exploration and production, the preparation of subterranean services ducts, and in other civil engineering applications.

Taking the drilling of oil and gas wells as an example, it is highly desirable both for economic and for engineering reasons, to obtain information about the progress of the borehole and the strata which the drilling bit is penetrating from instruments positioned near the drilling bit, and to transmit such information back to the surface of the earth without interruption to the drilling of the borehole. The generic name associated with such techniques is "Measurement-while-Drilling" (MWD). Substantial developments have taken place in MWD technology during the last twenty-five years.

One of the principal problems in MWD technology is that of reliably telemetering data from the bottom of a borehole, which may lie several thousand metres below the earth's surface. There are several established methods for overcoming this problem, one of which is to transmit the data, suitably encoded, as a series of pressure pulses in the drilling fluid; this method is known as "mud pulse telemetry".

A typical arrangement of a mud pulse MWD system is shown schematically in FIG. 1. A drilling rig (50) supports a drillstring (51) in the borehole (52). Drilling fluid, which has several important functions in the drilling operation, is drawn from a tank (53) and pumped, by pump (54) down the center of the drillstring (55) returning by way of the annular space (56) between the drillstring and the borehole (52). The MWD equipment (58) that is installed near the drill bit (59) includes a means for generating pressure pulses in the drilling fluid. The pressure pulses travel up the center of the drillstring and are received at the earth's surface by a pressure transducer (57). Processing equipment (60) decodes the pulses and recovers the data that was transmitted from downhole.

In one means of generating pressure pulses at a downhole location, the fluid flowpath through the drillstring is transiently restricted by the operation of a valve. This creates a pulse, the leading edge of which is a rise in pressure; hence the method is colloquially, although rather loosely, known as "positive mud pulse telemetry". In contradistinction the term "negative mud pulse telemetry" is used to describe those systems in which a valve transiently opens a passage to the lower pressure environment outside the drillstring, thus generating a pulse having a falling leading edge.

Devices for the generation of pulses for positive mud pulse telemetry have been described in, for example, U.S. Pat. Nos. 3,958,217, 4,905,778, 4,914,637 and 5,040,155. The above references represent only a few of the very many pulse generating devices that have been developed over a relatively long period of time.

In U.S. Pat. No. 5,040,155, there is described a type of fluid pulse generator in which the operating energy is derived by creating a pressure drop in the flowing drilling fluid: this differential pressure is used to actuate a main valve element under the control of a pilot valve.

The present application describes an invention which advantageously improves the capability of pulse generators of the general type described in U.S. Pat. No. 5,040,155 for operation in the presence of certain fluid additives, and at the same time improves the lifetime of the equipment.

According to the invention there is provided a pressure pulse generator as defined in claim 1.

A pressure pulse generator according to the invention functions entirely differently from the known pressure pulse generators e.g. of the type known from U.S. Pat. No. 5,040,155, in that in the invention fluid only flows for a relatively brief instant through the housing when a pressure pulse signal is being generated, whereas at all other times the fluid by-passes the housing i.e. does not pass through it. Evidently, this is a substantial improvement in the art, and gives a greatly enhanced working life of the generator.

In the known arrangement, there is continuous fluid flow through the housing, except during the brief time instants in which pressure signals are being generated. In the known arrangements, therefore, there is much greater (and longer) exposure of the internal components, passages, ducts etc to the abrasive action of the pressure fluid (and any solids carried thereby).

Figure 2:
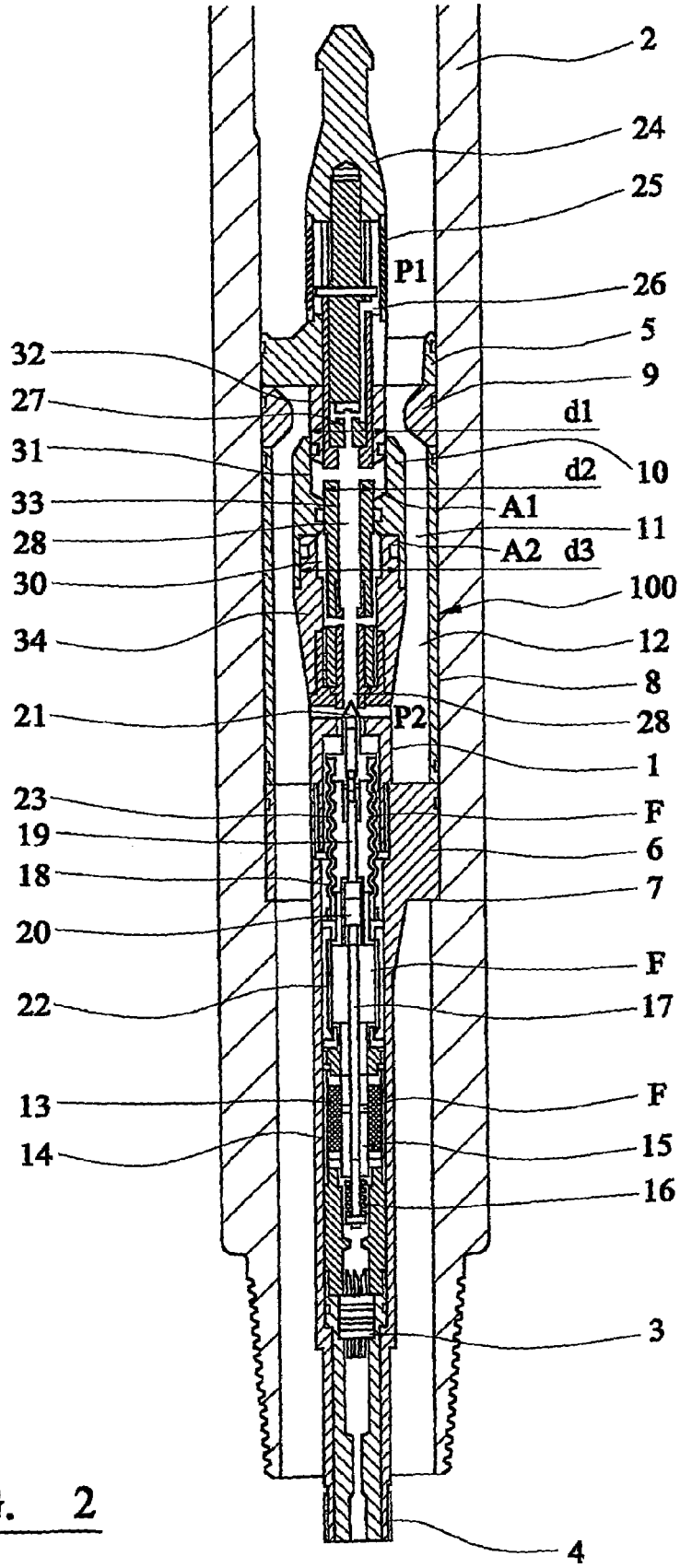
FIG. 2 is a detail view, in vertical cross-section of a general type of pressure pulse generator to which the invention may be applied.

First, the basic construction and operation of a pulse generator will be reviewed, with reference to FIG. 2 of the accompanying drawings. This will serve to make clearer the advantages of the invention which will be shown in the second part of the description, with reference to a preferred embodiment shown in FIGS. 3 and 4 of the accompanying drawings.

FIG. 2 shows a cross-section of a generally cylindrical pressure pulse generating device. The pulse generator 1 is installed in a drill string 2 of which only a part is shown. The flow of drilling fluid within the drill string is downwards in relation to the drawing orientation. The pressure pulse generator is shown terminated by electrical and mechanical connectors 3 and 4 respectively, for the connection of other pressure housings which would contain, for example, power supplies, instrumentation for acquisition of the data to be transmitted and a means for controlling the operation of the pulse generator itself. Such sub-units form a normal part of an MWD system and will not be further described herein.

The pulse generator has a housing 100 which is mounted and supported in the drill string element by upper and lower centralisers 5 and 6 respectively. The centralisers have a number, typically three, of radial ribs between an inner and outer ring. The spaces between the ribs allow the passage of drilling fluid. The ribs may be profiled in such a way as to minimise the effects of fluid erosion. The lower centraliser 6 rests on a shoulder 7 in the drill string element. A spacer sleeve 8 supports a ring 9 and protects the bore of the drill string element from fluid erosion. The ring 9 together with a main valve element 10 (which will be described in more detail later), define an inlet arrangment to the interior of housing 100 and at the same time form a significant restriction to the passage of fluid. The pulse generator is locked into the drillstring element by conventional means (not shown) to prevent it rotating or reciprocating under the influence of shock and vibration from the drilling operation.

Considering for the moment only the main flow, drilling fluid, supplied from the previously described storage tanks and pumps at surface, passes the upper centraliser 5, the ring 9, a main valve assembly 11 (incorporating valve element 10) and the lower centraliser 6 before proceeding downwardly towards the drill bit. As is well known, the drilling fluid returns to surface by way of the annular space between the drilling assembly and the generally cylindrical wall of the hole being created in the earth by the drill bit.

The flow of drilling fluid through the restriction formed by the ring 9 and the main valve element 10 creates a significant pressure drop across the restriction. The absolute pressure at a point such as P1 is principally composed of the hydrostatic pressure due to the vertical head of fluid above that point together with the sum of the dynamic pressure losses created by the flowing fluid as it traverses all the remaining parts of the system back to the surface storage tanks. There are other minor sources of pressure loss and gain which do not need to be described in detail here. It should be noted that the surface pumps are invariably of a positive displacement type and therefore the flow through the system is essentially constant for a given pump speed, provided that the total resistance to flow in the whole system also remains essentially constant. Even when the total resistance to flow does change, the consequent change in flow is relatively small, being determined only by the change in the pump efficiency as the discharge pressure is raised or lowered, provided of course that the design capability of the pumps is not exceeded.

Figure 1:
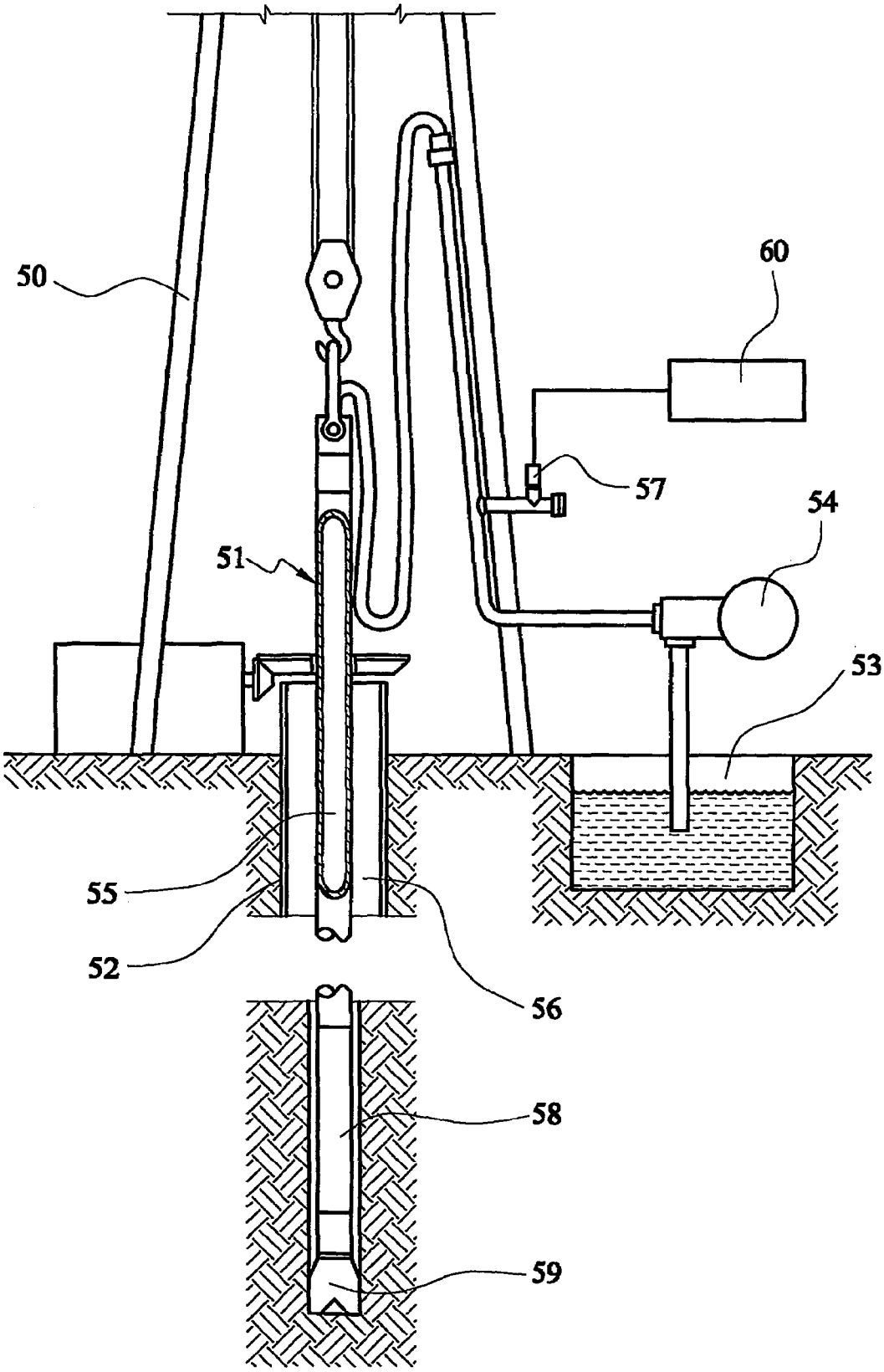
FIG. 1 is a schematic illustration of a typical drill string installation with which a pressure pulse generator according to the invention may be used.

The pressure at a point such as P2 is lower than that at P1 only by the pressure loss in the restriction described above, the change in hydrostatic head being negligible in comparison with the length of the well bore. Although some pressure recovery occurs, as is well known, in the region where the flow area widens out, at 12 in FIG. 1, the main restriction at the ring 9 and the main valve 10 nevertheless causes a clear pressure differential, proportional approximately to the square of the flow rate, to appear across the points indicated.

The inner assembly contains an electromagnetic actuator with coil 13, yoke 14, armature 15, and return spring 16. A first shaft 17 connects the actuator to a control spring housing 18. A second shaft 19 connects the upper end of the control spring 20 to a pilot valve element 21.

As is customary in apparatus of this kind, there are parts of the assembly that are preferably to be protected from ingress of the drilling fluid, which usually contains a high proportion of particulate matter and is electrically conductive. In FIG. 2 the volumes indicated by the letter F are filled with a suitable fluid such as a mineral oil, and there is communication between these volumes by passageways and clearances not shown in detail. It is important for the operation of the pulse generator that the pressure in the oil-filled spaces should be held always equal to that of the drilling fluid surrounding it. Were this not so, the differential pressure between the two regions would lead to an unwanted axial force in one or other direction on shaft 19. A compliant element 22 provides this pressure equalising function, as does the compliant bellows 23. Between them these two elements allow the internal volume of the oil-filled space to change, either by expansion of the oil with temperature, or by axial movement of the bellows, without significantly affecting the force acting on shaft 19. This volume-compensated oil fill technique is well known.

At the top of the pulse generator there is a probe 24 that carries a cylindrical filter element 25. (The profile of the top of the probe is designed to allow a retrieval tool to be latched to it, and is not otherwise significant to the subject of this application.) There is fluid communication from the inside of the filter 25 through the passages 26, 27, 28 to an orifice 29 immediately above the pilot valve element 21. This fluid is also in communication with the space 30 below the main valve element 10 and the space 31 above the main valve element.

The main valve element 10 is slideably mounted on the structural parts of the assembly 32, 33, 34. It is to be noted that the effective operating areas, upon which a normally directed force component may cause the valve to move are the ring-shaped areas denoted as A1 and A2 in FIG. 1. Area A1 is defined by the diameters shown as d1 and d2. Area A2 is defined by the diameters shown as d2 and d3

When fluid flows through the pulse generator, a small portion of the flow bypasses the main flow areas and passes through the filter 25 and the passageways 26, 27, 28 to the pilot valve orifice 29. Passageway 27 forms a restriction controlling this pilot flow and ensuring that the pressure in passageway 28 is substantially less than the pressure P1. In this condition the pulse generator is inactive. The pressure in passageway 28 is communicated both to area A1 and area A2. The areas A1 and A2 are chosen so that the product (pressure in passageway 28)×(A2−A1) is insufficient to overcome the downwardly directed hydrodynamic force, caused by the main fluid flow, and the main valve element 10 remains in its rest position.

To cause a pressure pulse to be generated in the main flow, the coil 13 is energised and the armature 15 moves upwards. This motion is transmitted to the shaft 17 and the control spring 20.

The function of the control spring 20 is fully disclosed in a separate and co-pending PCT patent application filed in the name Geolink (UK) Ltd on the same day as the present application, and for the purposes of the present invention it is immaterial whether the spring is present or whether it is replaced by a rigid connection. The disclosure concerning the control spring is intended to be incorporated in the present specification by this reference.

To keep the subject matter of the present invention clear and distinct, the explanation which follows assumes simply that the control spring 20 has a very high rate, sufficient for it to behave at all times as if it were effectively a rigid connection.

Returning to the description of operation, the pilot valve 21 is carried upwards until it closes the pilot orifice 29.

The closure of the pilot orifice stops the pilot flow and as a result the pressure throughout the set of passageways below the filter element 25 rises to the same value as the pressure at the exterior of the filter, the pressure P1. This pressure is applied to the areas A1 and A2, and since area A2 is substantially larger than A1 a net upwards force is applied to the main valve element 10. This force is sufficient to overcome the hydrodynamic resistance to movement and the valve element 10 moves upwards to increase the restriction offered to flow at the area between it and the ring 9. Because the flow remains essentially constant, as described earlier, the pressure P1 now rises substantially. This change in pressure is detectable at the surface of the earth and forms the leading edge of a data pulse. When the coil 13 is de-energised, the forces provided by the pressure drop across the pilot valve and by the return spring 16 move the pilot valve back to its rest position. The net force on the main valve element is reversed in direction and the valve returns to the quiescent position described earlier. The excess pressure is relieved and the pressure change detected at surface forms the trailing edge of the data pulse. In the basic form described above the pulse generator operates generally according to the principles described in U.S. Pat. No. 5,040,155.

The present invention provides a substantial advantage in the operability of the pulse generator, as compared with the prior art, which will now be described.

Most drilling fluids are highly abrasive: they contain fine particulate solids which may be present in the original formulation and which accumulate from the rock formation being drilled as the fluid circulates: the screens and hydrocyclones that remove rock cuttings and relatively small particles cannot remove, for example, extremely fine sand grains. It is well known that the presence of such particulate matter enhances the already significant erosive ability of high velocity fluid jets.

Furthermore there are many occasions on which it is necessary to introduce matter of relatively large particulate size into the circulating drilling fluid. Usually this is one of a group of materials known collectively as "lost circulation material" and its function is to prevent loss of drilling fluid into exceptionally porous and permeable regions of the borehole wall. It is selected for its ability to adhere to and form an impermeable surface on the borehole wall.

It will be noted that in the basic form of the device described above, drilling fluid flows continuously through the filter element 25, the passages 26, 27, 28 and the orifice 29 except during the generation of a pressure pulse. In many mud pulse telemetry systems the pulse duty cycle is much less than 1:1. Depending on the encoding system and sometimes on constraints on the amount of energy available to power the system, the duty cycle may be as low as 1:10, that is, the generator is in the active condition for only 10% of the time it is in use.

In the pulse generator as described above, the continuous flow of fluid through the filter 25 and the orifice 29 can lead to relatively rapid erosion of the parts exposed to high velocity fluid. Although the filter element 25 can be designed so that the fluid velocity is initially low, the continuous flow can rapidly lead to partial blockage, followed by erosion of the filter element. These are matters which can be dealt with by careful design and regular maintenance. It is however of great importance in MWD systems in general to maximise the time intervals between maintenance operations. It is well known that the operation of bringing a drill string to surface and replacing it in the hole is time-consuming and expensive, representing time completely lost to the drilling operation. Drilling operations are designed so that, as far as possible, the string is only removed from the well for the purpose of changing the drill bit or for major operations such as setting casing. It is therefore extremely desirable that the ancillary parts of the bottom-hole assembly of the drillstring can operate for the whole time of a so-called bit run, which may be of many days duration, without requiring maintenance.

An even more serious disadvantage of the basic pulse generator described above arises when lost circulation material (LCM) is added to the circulating fluid: it will block the filter 25 immediately and the pulse generator can no longer operate. Furthermore this material does not quickly get washed off the filter even when the bulk of the material is removed from the main circulation because it is held in place by the differential pressure across the filter element and tends to become jammed in the filter holes or slots. This effect is hardly surprising, since it is exactly what lost circulation material is designed to do at the borehole wall, namely to block up small holes under the influence of differential pressure.

The invention that is the subject of this patent application and which overcomes the disadvantages detailed above will now be described with reference to a preferred embodiment (by way of example only) shown in FIGS. 3 and 4.

Figure 3:
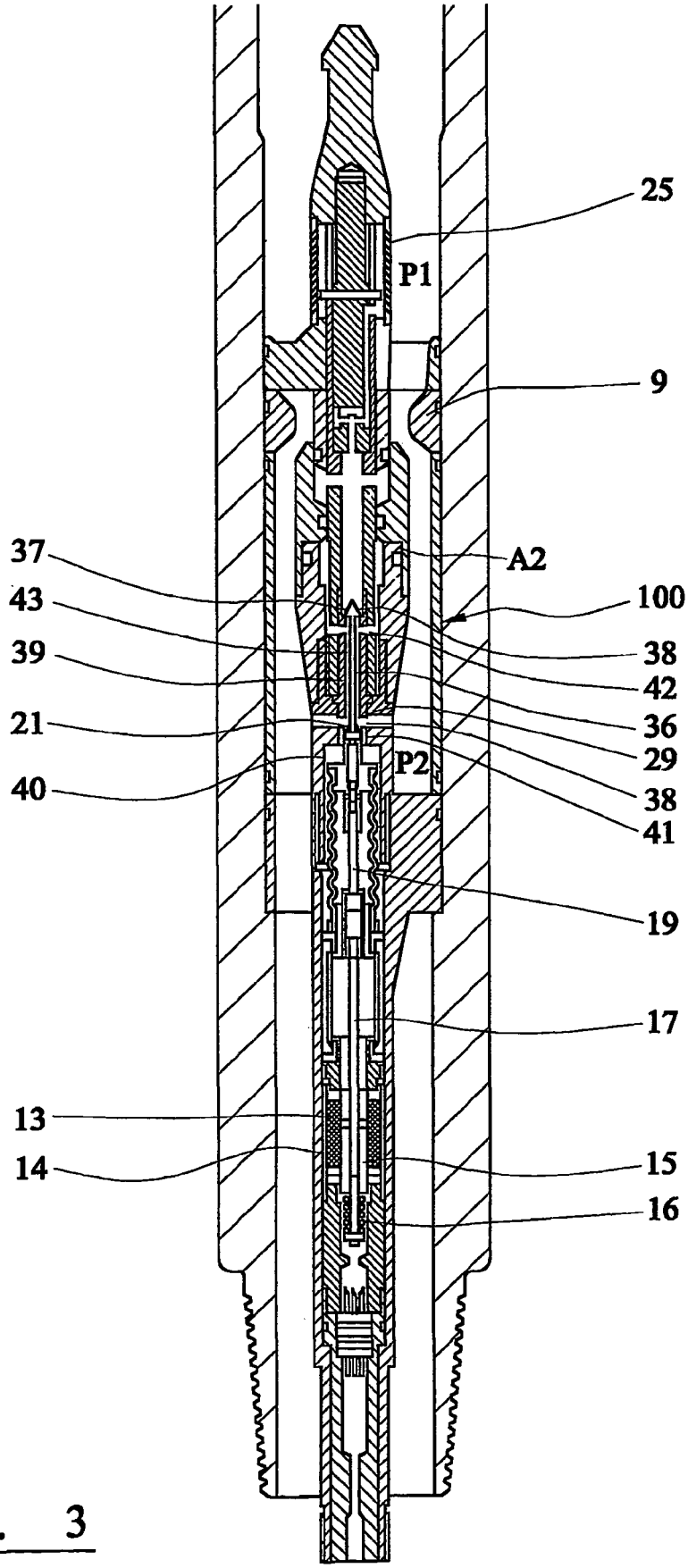
FIG. 3 is a view, similar to FIG. 2, of a preferred embodiment of pressure pulse generator according to the invention; and, FIG. 4 is a detail view, to an enlarged scale, of a pilot valve arrangement of the generator shown in FIG. 3.
Figure 4:
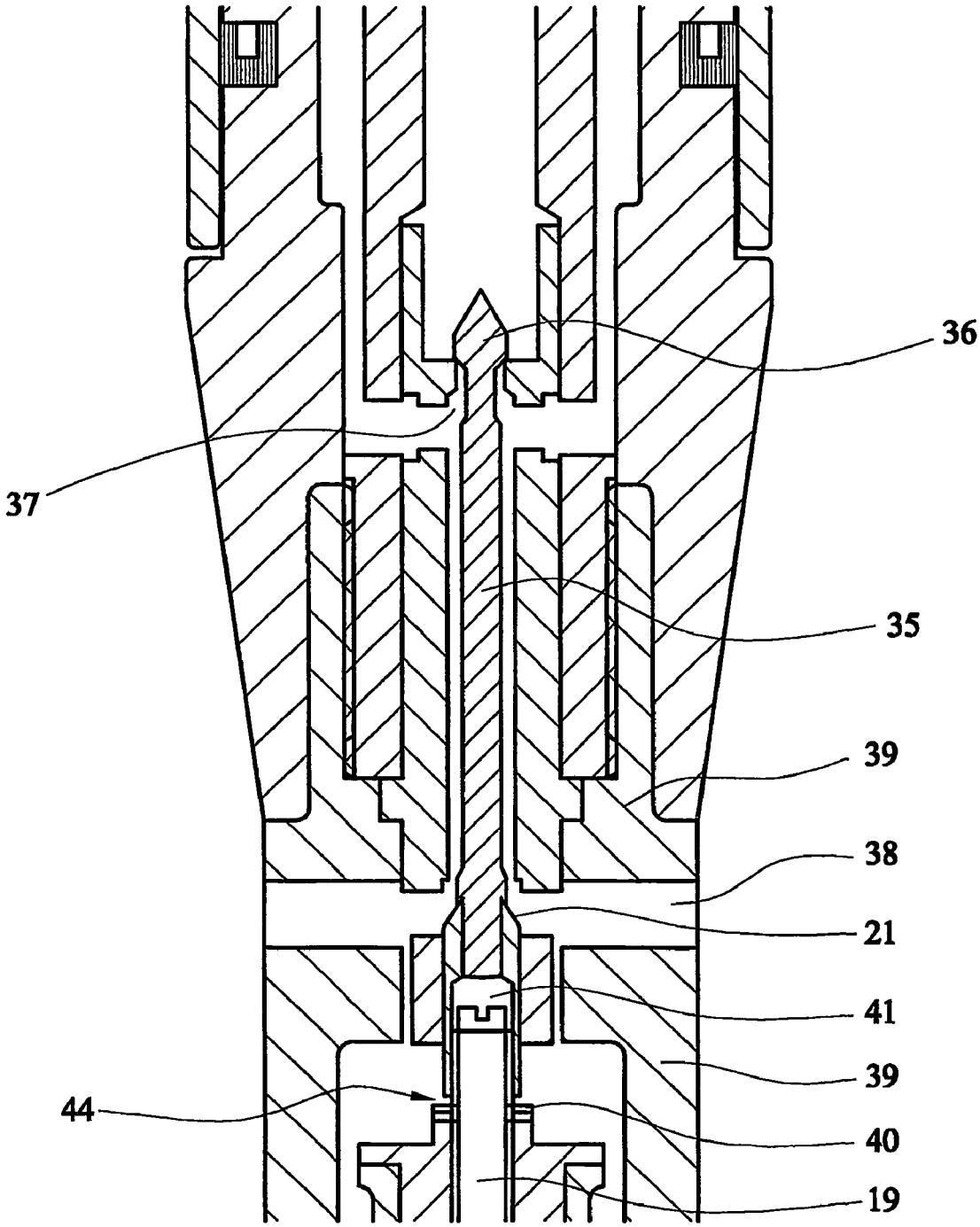

FIG. 3 shows a pulse generator according to this invention. For clarity part of the drawing is reproduced at larger scale at FIG. 4, and which shows an enlarged view of the upper end of an actuating link connected to pilot valve 21.

The head of the pilot valve 21 is now also connected to push rod 35. At its upper end push rod 35 carries a push-off valve head 36 above a secondary orifice 37 (forming a secondary valve). Upwards movement of the valve head 36 allows fluid to pass to the operating area A2 of the main valve element 10 and to the pilot valve 21, 29. As before, radial passages 38 in the generally cylindrical auxiliary valve housing 39 communicate between the pilot valve and the lower pressure volume at P2. It is important to note that actuator head 40 is not rigidly connected to the pilot valve assembly 21. There is a small clearance 44 between the actuator head 40 and the lower surface of the push rod 35. There is a further small clearance 41 between the upper surface of shaft 19 and the lower face of the cavity at the base of push rod 35 (see FIG. 4).

In the quiescent position of the armature 15, there is differential pressure, as described earlier, between the passages communicating with filter 25 and the lower pressure region P2. It can be seen that this pressure appears across the closed secondary valve 36, 37. The valve head 36 experiences a net force tending to keep it closed against orifice 37, and the clearances at 41 and 44, described previously, ensure that the valve 36 is indeed free to close fully irrespective of changes in temperature, slight wear of the parts and assembly tolerances. Consequently the fluid in the operating region of the main valve element 10 is in communication, via the pilot valve 21, 29 with the low pressure at P2. This is the same situation as obtained in the originally described pulse generator, with the single and important exception that there is now no continuous flow through the filter 25 or the pilot valve 21, 29 when the pulse generator is in the quiescent state.

When it is required to create a pressure pulse the coil 13 is energised. First actuator shaft 17 moves upwards simultaneously carrying shaft 19 (remembering that for the purposes of this description the spring 20 is considered to be rigid). Actuator head 40 moves upwards, closing the gap 44 and transmitting motion to the push rod 35 which is thereby also carried upwards. At this point, several simultaneous events occur. The secondary valve 36, 37 starts to open, admitting fluid to passages 42, 43 (FIG. 3). The pilot valve 21 starts to close, tending to block the flow of the newly released fluid into the low pressure region P2. The pressure from region P1 now starts to be communicated to the operating area A2 of the main valve element 10, and the latter starts to move as previously described.

With the completion of the closure of the gap between armature 15 and yoke 14, the system is now in exactly the same on-pulse condition as was described earlier for the basic pulse generator, but that state has been achieved with no more than a small transient flow of drilling fluid through the filter 25 and the associated passages.

When the coil 13 is de-energised, the return spring 16 causes the armature 15 to return to its rest position. This frees the pilot valve element 21 and the attached secondary valve element 36 to return to their original positions under the influence of differential pressure. The pressure acting on area A2 falls back to the pressure at P2. The main valve element 10 is now acted on by a downwards force and it returns to its quiescent condition. Once again this operation is achieved with only a small transient flow through the filter element 25.

This invention is equally applicable when it is used in conjunction with the pulse-height determining mechanism described in our co-pending PCT application.

Tests have been conducted using a highly effective lost circulation material known as "medium nut plug". It is typically introduced into the drilling fluid flow in quantities between 10 lb and 30 lb per US barrel (28 kg~84 kg per cubic meter). A pulse generator not fitted with the invention stopped operating immediately this material was introduced into the flow stream even at a concentration below 5 lb per US barrel (14 kg per cubic metre). A pulse generator with the modification described above continued to operate in fluid containing 30 lb per US barrel (84 kg per cubic metre) of medium nut plug with no deterioration in performance.

It has further been noted in tests that, as expected, the wear rate of the parts associated with the pilot valve element 29 is reduced to low levels as compared with a pulse generator not having this invention attached.

For a pulse generator of the type described herein, the reduction in wear rate can be estimated as follows.

There is a finite time during which flow occurs through the pilot valve each time the pulse generator is activated and each time it is deactivated. When the generator is established in the activated state ("on-pulse") there is no flow, and when it is in the deactivated state ("off-pulse") again there is no flow.

Suppose that for each pulse, the ratio of the total transition time to the on-pulse time is R1. Suppose also that the ratio of on-pulse to off-pulse time is Rt.

Suppose also that the time period T is long enough for many pulse operations to take place during it.

Then in a pulse generator of the basic type, without the invention described herein, during a period T:

The generator is on-pulse for a period Rt.*T. There is transient flow through the pilot for the period R1*Rt.*T and also whenever the device is off-pulse. Only for the remaining time t does pilot flow stop.

From the above, during a period T, t=T−(R2.T)+(R1.R2.T). The ratio t/T is (1−Rt.(1−R1)). This is the fraction of the total operational time during which flow takes place through the pilot valve.

In contrast, for the pulse generator built according to the present invention, pilot flow is on during the interval T only during the transient phase of the valve operation. In this case the ratio t/T is just R1.R2.

In a typical system, R1 might be 0.2 (two transient periods of 50 ms each during a 500 ms pulse) and Rt. might be 0.1. Rt. may of course be much higher, for example in a case where items of data are being transmitted continuously, or it may be much lower, as in the case when the system is solely transmitting some directional data every few hours. It is reasonable to suppose however that Rt. ranges from 0.05 to 0.5.

Thus fraction of operational time during which pilot flow is occurring in the case of the system in the absence of the invention, using the above numbers, ranges from 0.96 (Rt.=0.05) to 0.60 (Rt.=0.5).

The fraction of operational time during which pilot flow is occurring in the system incorporating the present invention, using the same numbers, ranges from 0.01 (Rt.=0.05) to 0.1 (Rt.=0.5).

The improvement provided by the invention in respect of fluid erosion of the pilot valve parts can be quantified as the ratio of the relative pilot-flow-on periods. This is 96 when Rt.=0.05 and 6 when Rt.=0.5). Thus, other things being equal, the wear parts of the pilot flow system in the present invention will have an advantage in lifetime or service interval over the basic form of generator by a factor ranging from six to ninety-six time.

Although not shown in the drawings, by-pass ports may be provided in the restrictor ring in order to provide a primary pressure drop. The by-pass may be used to increase the flow capability, without having to change the size of the main valve parts. This may be important, because it means that the central part of the pulse generator can be exchanged across different pipe bores; only the mounting components have to be changed.

The relative area of the by-pass ports may be of critical importance in a given flow situation. If the by-pass area is too large, there is insufficient initial pressure drop, the operation of the main valve becomes sluggish, and the pulse amplitude too low. If the by-pass area is too small, the flow velocity through the main valve becomes too great, causing rapid erosion. A by-pass ring may be provided with multiple ports that can easily be opened or closed at the well site, by the insertion of the correct number of "lock-in" plugs.

The invention claimed is:

1. A pressure pulse generator for use in transmitting pressure signals to surface in a fluid-based drilling system, said generator being arranged in use in the path of a pressurized fluid to operate a drilling assembly and being operative, upon actuation, to generate pressure signals in such fluid for transmission to surface pressure monitoring equipment, in which the pulse generator comprises:

an outer housing positionable in the path of the supply of pressurized fluid, said housing having an inlet arrangement for admitting a portion of the fluid to the interior of the housing, and an outlet arrangement for discharging fluid from the interior of the housing for supply to the drilling assembly;

a control element slidably mounted in the housing for movement between an open and a closed position with respect to said inlet arrangement, said control element being operative to generate a pressure pulse in the supply of pressure fluid when the control element takes-up the closed position;

a control passage extending through the control element and closable by a valve element arranged to be exposed to the pressure of the fluid in the passage; and an actuator assembly which is connected to the control element and which, upon actuation, moves the control element relative to the inlet arrangement in order to generate a pressure pulse in the fluid for transmission to the surface, said actuator assembly also, when deactivated, blocking the flow of fluids through the control passage so that all of the fluid flows as by-pass flow via the inlet arrangement, in which the actuator assembly includes a pilot valve which is connected via a first mentioned actuator to be moved between an open and the closed position with respect to a valve seat in order to activate or deactivate the pulse generator, said pilot valve being connected to a secondary valve via a further actuator, said secondary valve blocking flow through the control passage when the first mentioned actuator is deactivated.

2. A pressure pulse generator according to claim 1, in which the pilot valve is connected to the first mentioned actuator via a lost-motion connection.

3. A pressure pulse generator according to claim 1, in which the first mentioned actuator connected to the pilot valve comprises a first actuator connected to an electromagnetic actuator, a second actuator connect to the pilot valve, and a connector between the first and second actuators.

4. A pressure pulse generator according to claim 1, in which the inlet arrangement comprises a fixed ring mounted internally of the housing and which defines an internal entry passage for fluid between itself and said moveable control element.

5. A pressure pulse generator according to claim 4, in which the ring defines, or includes a by-pass port.

* * * * *